United States Patent [19]

Foley et al.

[11] Patent Number: 4,791,449

[45] Date of Patent: Dec. 13, 1988

[54] SYSTEM FOR PREVENTION OF UNAUTHORIZED COPYING

[75] Inventors: Geoffrey M. Foley; Robert W. Anderson, both of Fairport, N.Y.

[73] Assignee: Xerox Corporation, Stamford, Conn.

[21] Appl. No.: 868,984

[22] Filed: May 30, 1986

[51] Int. Cl.[4] ..... G03G 21/00

[52] U.S. Cl. ..... 355/3 R; 283/902; 355/133; 427/7; 428/326; 428/916

[58] Field of Search ..... 355/3 R, 133, 14 R; 427/7; 428/326, 690, 915, 916; 283/92, 902

[56] References Cited

U.S. PATENT DOCUMENTS

| | | | |
|---|---|---|---|
| 3,090,687 | 5/1963 | Berman | 355/133 X |
| 3,591,283 | 7/1971 | Peisach | 355/133 X |
| 3,597,082 | 8/1971 | James et al. | 355/133 |
| 3,700,324 | 10/1972 | Hutner et al. | 355/6 |
| 3,708,378 | 1/1973 | Tung | 161/6 |
| 3,713,861 | 1/1973 | Sharp | 427/7 |
| 3,811,770 | 5/1974 | Baus, Jr. et al. | 355/67 |
| 3,831,007 | 8/1974 | Braun | 235/61.11 |
| 3,852,088 | 12/1974 | Godlewski et al. | 355/133 X |
| 3,928,226 | 12/1975 | McDonough et al. | 252/301.2 |
| 3,936,567 | 2/1976 | Vesely | 428/325 |
| 3,977,785 | 8/1976 | Harris | 355/133 |
| 4,183,989 | 1/1980 | Tooth | 428/195 |
| 4,303,307 | 12/1981 | Tureck et al. | 428/916 X |
| 4,397,142 | 8/1983 | Binsgham | 57/238 |
| 4,442,170 | 4/1984 | Kaule et al. | 428/690 X |
| 4,451,530 | 5/1984 | Kaule et al. | 428/690 X |
| 4,522,429 | 6/1985 | Gardner et al. | 427/7 X |
| 4,586,811 | 5/1986 | Kubo et al. | 355/14 R |
| 4,603,970 | 8/1986 | Aota et al. | 355/133 |
| 4,678,322 | 7/1987 | Finkel et al. | 355/133 |

FOREIGN PATENT DOCUMENTS

| | | |
|---|---|---|
| 58-1482 | 1/1983 | Japan . |
| 1219192 | 1/1971 | United Kingdom . |
| 1332185 | 10/1973 | United Kingdom . |
| 2041827A | 9/1980 | United Kingdom . |

OTHER PUBLICATIONS

Harr et al., "No-Copy", Attachment for Copier, IBM Tech. Disclosure Bulletin, vol. 7, No. 11, 3434-3436, Apr. 1975.

Bruce, Unauthorized Copy Prevention, IBM Tech. Disclosure Bulletin, vol. 18, No. 1, 59-60, Jun. 1975.

Hobgood, Jr., Secure Document for Copy Machines, IBM Tech. Disclosure Bulletin, vol. 15, No. 2, 59-60, Jul. 1972.

IBM Technical Disclosure Bulletin, vol. 19, No. 4, Sep. 1976.

*Primary Examiner*—Fred L. Bruan

*Attorney, Agent, or Firm*—Peter H. Kondo

[57] ABSTRACT

A web having phosphor particles uniformly distributed on at least one outer surface of the web, the phosphor particles being substantially white or colorless under ambient room light illumination and which upon excitation by ultraviolet light phosphoresces to emit visible radiation having a wavelength between about 400 nanometers and about 500 nanometers for a detactable period after ultraviolet excitation. Imaged webs having phosphor particles uniformly distributed on at least one outer surface thereof may be employed in an imaging process the steps of illuminating the outer surface bearing an image with ultraviolet light during an electrostatographic imaging cycle to cause the phosphor particles to emit visible light, terminating the illumination of the outer surface bearing the image with the ultraviolet light, detecting the visible light emitted by the phosphor particles and altering at least one element of the electrostatographic imaging cycle in response to the detection of the visible light whereby the electrostatographic imaging cycle is disabled.

16 Claims, 2 Drawing Sheets

SYSTEM FOR PREVENTION OF UNAUTHORIZED COPYING

BACKGROUND OF THE INVENTION

This invention relates in general to copy prevention, and more specifically, to a web and process for using the web for preventing unauthorized copying.

Various approaches have been conceived for preventing the unauthorized copying of documents.

In an abstract entitled "No-Copy" Attachment For Copier, J. D. Harr et al, IBM Technical Disclosure Bulletin, Vol. 17, No. 11, Apr. 1 1975, pp 3434 and 3435, a system is described in which a document having fluorescent material deposited in or on it that is invisible under normal lighting, fluoresces red under long wavelength ultraviolet radiation of the background areas of an original. The red radiation emitted during exposure to ultraviolet radiation is detected by suitable sensors which activate means to interrupt the functioning of a copier. In other words, detection of a response to illumination by ultraviolet radiation occurs in the wavelength domain. Since paper having an ordinary white appearance is preferred by most users and since ultraviolet light from artificial or natural lighting is normally present under ordinary ambient conditions, the presence of a red radiating material in paper may impart a nonwhite coloration to paper. Another disadvantage of this concept is that one can easily identify fluorescent material protected original documents by illumination with a simple blacklight. Moreover, since fluorescent materials that fluoresce in the blue color range are usually employed in paper to impart a whiter appearance to the paper in room light, fluorescent copy prevention materials that radiate blue would be unsuitable for the system described in the IBM Technical Disclosure Bulletin.

Fluorescent toners have also been suggested in Japanese Patent Publication No. 58-14842 to Tomoegawa Seishijiyo K.K., published Jan. 27, 1983. These toners fluoresce during copying so that the photoreceptor cannot distinguish the image areas from the non-image areas. Unfortunately, some fluorescent materials cannot readily be employed with standard light sources already in a copier because the light source emits wavelengths that do not encompass the wavelength needed to activate the fluorescent material and/or the photoreceptor is insensitive to the wavelengths emitted by the fluorescing toner. The required use of special toner compositions limits applicability of this concept to specific classes of machines specifically designed to handle such materials and may require trade-offs in copy quality over typical toners. The toner also appears to require specific exposure sources and photoreceptors for effective operation because it relies on the resulting image contrast between print and background regions to be small. Moreover, special toners of this type would also normally require replacement of the toner when the copier is to be used for making copyable documents.

In British patent publication No. 1,332,185, published Oct. 3, 1969, certain photochromic materials are suggested to render an original document uncopyable. However, like many fluorescent materials, some photochromic materials cannot readily be employed with standard light sources already in a copier because activation of the photochromic materials require light in a specific wavelength regime which may lie outside the wavelength of the exposure source already in the copier Furthermore, in modern flash illuminating copiers, the exposure time may be insufficiently long for the photochromic change to be functional. In addition, the technique again requires the image contrast between the print and the background regions to become sufficiently small to become unreadable. Also, the original once activated generally requires special treatment to recover its original condition within a reasonable time, a clear disadvantage.

Magnetic toners have also been suggested for incorporation into original documents to prevent copying. However, such use requires that an original be made xerographically and that a dedicated copier containing magnetic toner be utilized to form the uncopyable document. The copier used to form the magnetic images cannot readily be used to form copies with non-magnetic images because of the inconvenience of changing the toner from magnetic toner to non-magnetic toner and also because the design parameters of a xerographic engine utilizing magnetic toner are different in general from those for an engine utilizing nonmagnetic toner. Further, since magnetic toners are already widely used for conventional copying purposes, their use as a copy prevention marker for secure documents would tend to be precluded.

In an abstract entitled Unauthorized Copy Prevention, G. D. Bruce, IBM Technical Disclosure Bulletin, Vol. 18, No. 1, June 1975, p 59 and in U.S. Pat. No. 3,831,007 to J. P. Braun, a modulated image on the background areas of an original is detected by suitable sensors. However, the modulated image is visible and imparts to the document an unusual appearance different from ordinary paper.

In U.S. Pat. No. 3,713,861, an imaged document is coated, for example, with an overcoating which fluoresces in both the image areas and the background areas during the exposure step of an electrophotographic copying process to prevent image formation on a photoreceptor. The application of an additional overcoating involves an inconvenient extra processing step. Moreover, the coated paper is not aesthetically equivalent to ordinary paper.

Some copy prevention systems form distorted images. But, even in these systems that form copies bearing distorted images of the original images, the images formed are often still readable.

While systems utilizing the above-described known approaches may be suitable for their intended purposes, there continues to be a need for the development of an improved system for preventing unauthorized copying which avoids paper having an unusual appearance; components that are difficult or impossible to be installed by the owner or a technical representative at the site of a machine to be modified; costly hardware; easily detectable copy prevention webs; special photoreceptors or exposure lamps; machines having an anti copying capability that is difficult for the owner to turn off and the like.

SUMMARY OF THE INVENTION

It is an object of this invention to provide a novel web for electrostatographic imaging which overcomes the above-noted disadvantages.

It is another object of this invention to provide a novel web which is white under normal ambient conditions.

It is still another object of this invention to provide an imaging system which prevents the copying of certain originals.

It is another object of this invention to provide a copy prevention system that allows simple, low cost conversion by the owner or a technical representative at the site of the machine to be modified.

It is still another object of this invention to provide a copy prevention system that is simple, low cost and readily incorporated into existing designs at the time of manufacture.

It is another object of this invention to provide an imaging web that may be utilized in all electrostatographic imaging systems independent of the specific photoreceptor or exposure lamp characteristics of the system.

It is still another object of this invention to provide an imaging system that may be easily turned off by the owner of the machine when desired.

It is another object of this invention to provide a specific embodiment of a novel web which is indistinguishable to the user from ordinary paper under normal ambient lighting and which cannot readily be distinguished from ordinary paper.

It is still another object of this invention to provide an imaging system that cannot be defeated by selectively masking an original.

The foregoing objects and others are accomplished in accordance with this invention by providing a web having phosphor particles uniformly distributed on at least one outer surface of said web, said phosphor being substantially white or colorless under ambient room light illumination and which upon excitation by ultraviolet light phosphoresces to emit visible radiation having a wavelength between about 400 nanometers and about 500 nanometers for a detectable period after ultraviolet excitation. This web bearing a light absorbing image may then be used in a process comprising illuminating the outer surface bearing the image with ultraviolet light during an electrostatographic imaging cycle to cause the phosphor particles to emit visible light, terminating the illumination of the outer surface bearing the image with the ultraviolet light, detecting the visible light emitted by the phosphor particles and altering at least one element of the electrostatographic imaging cycle in response to the detection of the visible light whereby the electrostatographic imaging cycle is disabled.

Any suitable web may be employed. The web may comprise conventional material such as cellulosic fibers, plastic fibers, continuous plastic sheets, and the like. It may be flexible, stiff, rigid and the like. The expression "web" employed herein may be of any suitable shape including continuous webs, cut sheets and the like.

Any suitable phosphor may be utilized on at least the outer surface of the web of this invention. Typical phosphor materials include silver activated zinc sulfide, europium activated yttrium vanadate, manganese activated magnesium germanate, europium activated thenoyl trifluoro acetonate, antimony activated calcium fluorophosphate, tungsten activated magnesium tungstate, barium pyrophosphate, and the like. For the purposes of this invention, a phosphor is a material which absorbs exciting radiation and re-emits radiation for a detectable period of time (following cessation of excitation) at a longer wavelength than the original radiation. This re-emission or phosphorescence decays in time and can quickly be measured in microseconds to seconds compared to the typical nanoseconds delay of fluorescent materials. Preferably, the phosphors of this invention decay in milliseconds to minimize the complexity of the detection system utilized to detect the re-emission of the phosphor materials after exposure to activating radiation. More specifically, the decay of phosphors of this invention emit radiation for a period of at least 1 microsecond and, more preferably, for a period exceeding at least 500 microseconds following termination of activating radiation. The longer the phosphor materials phosphoresce, the easier it is to integrate the emission over time by suitable detection devices such as silicon photodetectors and the like. The wavelengths emitted by the phosphor particles when struck by activating illumination may extend through the visible spectrum. A blue phosphorescent emission between about 400 nanometers and about 500 nanometers is particularly preferred when it is desired that it not be known that the original document is an uncopyable one because the webs treated with these phosphor particles resemble ordinary paper treated with conventional optical brighteners which fluoresce in the blue segment of the visible spectrum. Typical phosphor material which exhibit a blue phosphorescent emission when include silver activated zinc sulfide, antimony activated calcium fluorophosphate, tungsten activated magnesium tungstate, barium pyrophosphate, and the like. Otherwise, any suitable, detectable wavelength for the phosphorescent emission is acceptable.

Generally, the phosphor particles are activatable by ultraviolet activating radiation having a wavelength range between about 200 nanometers and about 400 nanometers. Activating radiation having a wavelength range between about 350 nanometers and about 400 nanometers is preferred because such radiation is transmitted without significant attenuation through the glass materials typically used in copier platens.

Preferably, the phosphor particles have an average particle size of between about 1 micrometer and about 50 micrometers. The phosphor particles may be of any suitable shape including spherical, flake, cubic, rod, regular, irregular and the like.

Generally, the phosphor material is distributed on at least the outer surface of the web. It may be distributed uniformly over the entire outer surface, in a uniform pattern, in a random pattern, or the like. Preferably, the phosphor particles are distributed over the entire outer surface of the web as a continuous coating or as a random or uniform pattern to defeat any attempts to mask the areas bearing the phosphorescent materials. The phosphor particles may be incorporated into the web materials during the web manufacturing process or as a coating applied to the web after the web is formed. If desired, a binder may be employed to bind the phosphor particles to the web. Any suitable binder may be utilized. Typical binders include starches, resins such as polystyrene, polyvinylbutyral, polymers of ethylene vinyl acetate, and the like. The particles should be distributed on at least the imaging surface of the web so that they can be activated by activating radiation and so that the phosphorescent emissions from the particles can be detected. The binder is preferably transparent to the emission activating illumination as well as the phosphorescent particles if the binder covers the phosphor particles. Where the phosphor particles are to be utilized with paper, it may be incorporated into the paper during the conventional paper making processes or applied as a coating to the paper subsequent to the formation of the paper web. Any suitable coating technique may be employed to apply the particles to the outer surface of the web. Typical coating processes include, roll coating, spraying, air knife, gravure, reverse roll coating, offset printing and the like.

The amount of phosphor material that should be present on the outer surface of the web depends upon the efficiency of the phosphor materials and the sensitivity of the detector. Generally, the web should carry at least about 300 milligrams of the phosphor material per square meter at the outer surface of the web to provide reasonable area coverage of the web by the phosphor, enabling acceptable phosphorescent emission levels consistent with reasonable light intensities and consistent with inexpensive detection systems. Short, medium or long wavelength ultraviolet may be utilized. Preferably, for systems in which the excitation source is positioned on the underside (nondocument side) of the platen. the excitation wavelength is in the ultraviolet range of from about 350 nanometers to about 400 nanometers, a region over which the platen glass provides good transmission.

Generally, the phosphor particles and the paper treated with the phosphor particles of this invention have a substantially white appearance under ordinary ambient illumination by sunlight, white fluorescent light, tungsten light and the like. The expression "substantially white" is intended to encompass the normal range of shading of ordinary paper from light yellow to white.

The intensity of the activating or excitation light source varies to some extent depending upon factors such as the length of exposure, the sensitivity of the phosphor utilized, the relative concentration of phosphor particles at the surface of the web, and the sensitivity of the detection devices employed.

The web may be illuminated by the excitation or activating light source at any suitable time prior to, during or after imaging exposure. The exposure may be continuous or pulsating. Excitation may occur by illumination of a stationary document with a single light pulse or multiple light pulses, such pulses being achieved either electronically or by mechanical means. In the case of a translating document (as in a moving platen system, for example) illumination by the excitation source may be continuous, exposure occurring in a slit wise fashion permitting phosphorescence detection at an adjacent point located in the direction in which the document is translating.

The webs of this invention may be utilized in any suitable imaging system that requires detection of differences in reflected light from an original document. In general, these include light lens systems and the various types of raster input scanners utilized to generate digitized inputs for printing engines, computerized storage and/or subsequent data transmission. Printing engines include xerographic systems, electrographic systems, electronic printers such as ink jet, holographic, stylus and the like.

In order to prevent copying of an original document the presence of phosphorescent emissions from the original must be detected. Any suitable detector may be utilized to detect the phosphorescent light emitted by the phosphor employed in this invention. Typical detectors include photodetectors comprising a photodiode and amplifier. The detector should be gated for phosphorescent emission in a particular wavelength regime and not for other emissions. Gating is accomplished by triggering the detection circuit using the excitation pulse or pulses and enabling detection of a phosphorescence signal in a predetermined time window some time interval after receipt of the trigger pulse. Preferably the trigger from the excitation pulse or pulses is provided by a second detector which is placed so as to detect the ultraviolet pulse or pulses from the excitation source reflected from the platen or by scattering from the front surface of the document. The criteria for selecting the sensing mechanism or detector depends upon the intensity and wavelength of the phosphorescent emissions from the original and may be any one of the conventional sensing devices such as silicon photodiodes and the like. A narrow band optical filter placed in front of the phosphorescence detector restricts detection of signals from spurious light sources and overload of the detector electronics. Ultraviolet light enhanced silicon photodiodes may be appropriately used as detectors for the excitation radiation. Typical photodetectors comprising photodiodes and amplifiers are commercially available, for example, from Sprague, EG & G and United Detector Technology (hybrid detector/amplifier combinations). The photodetectors should be located in the imaging system downstream of the phosphor excitation exposure. In xerographic systems, the detector can be positioned downstream of the excitation exposure and under the exposure platen such as described in detail below with reference to FIGS. 1 and 2. In sysems utilizing RIS-ROS devices, the detection device should be similarly placed downstream of excitation exposure. Detection of an excitation pulse or pulses by the excitation detector is not only a prerequisite to provide a gating signal for the phosphorescence detector but is required prior to enabling of the copy cycle to ensure that the excitation exposure device has not been inactivated. Furthermore, this detector may preferably be placed as described below with reference to FIG. 1 such that the excitation radiation detected is primarily that nonspecularly scattered (reflections outside the specular regime) from the surface of the document rather than that component specularly reflected from the front surface of the platen. Detection of this nonspecularly scattered radiation provides assurance not only that the excitation source is operating but also that an ultraviolet radiation absorbing material has not been placed between the platen and the document for purposes of defeating the copy protection system. Such an ultraviolet radiation absorber would not only prevent excitation of the phosphor but would eliminate the non specular low angle scattered radiation also.

After detection of the phosphorescent emission occurs, the imaging cycle may be disabled by any suitable technique. For example, in xerographic systems, scan can be stopped, imaging exposure lamps may be prevented from turning on, the developer bias may be raised to $V_{DDP}$, charging may be stopped, the fuser may be disabled, the transfer corotron may be turned off, an image distortion device could be brought into contact with toner image prior to fusing, and the like and combinations thereof. In RIS-ROS systems, the imaging cycle may be disabled by interception of the signal which modulates the ROS, erasure of the digitized signal in memory, and the like. In other words, the imaging cycle may be disabled at any point prior to the formation of the final print. Any suitable circuit may be utilized to turn on and turn off the excitation illumination, activate the detector and disable the imaging system. Typical circuits are described, for example, in the previously described abstract entitled "No-Copy" Attachment For Copier, J. D. Harr et al, IBM Technical Disclosure Bulletin, Vol. 17, No. 11, April 1975, pp 3434 and 3435; the abstract entitled Unauthorized Copy Prevention, G. D. Bruce, IBM Technical Disclosure Bulletin, Vol. 18, No. 1, June 1975, p 59 and U.S. Pat. No. 3,831,007 to J. P Braun; all three publications being incorporated herein by reference.

BRIEF DESCRIPTION OF THE DRAWINGS

Other aspects of the present invention will become apparent in view of the following description with reference to accompanying drawings.

Figure 1:
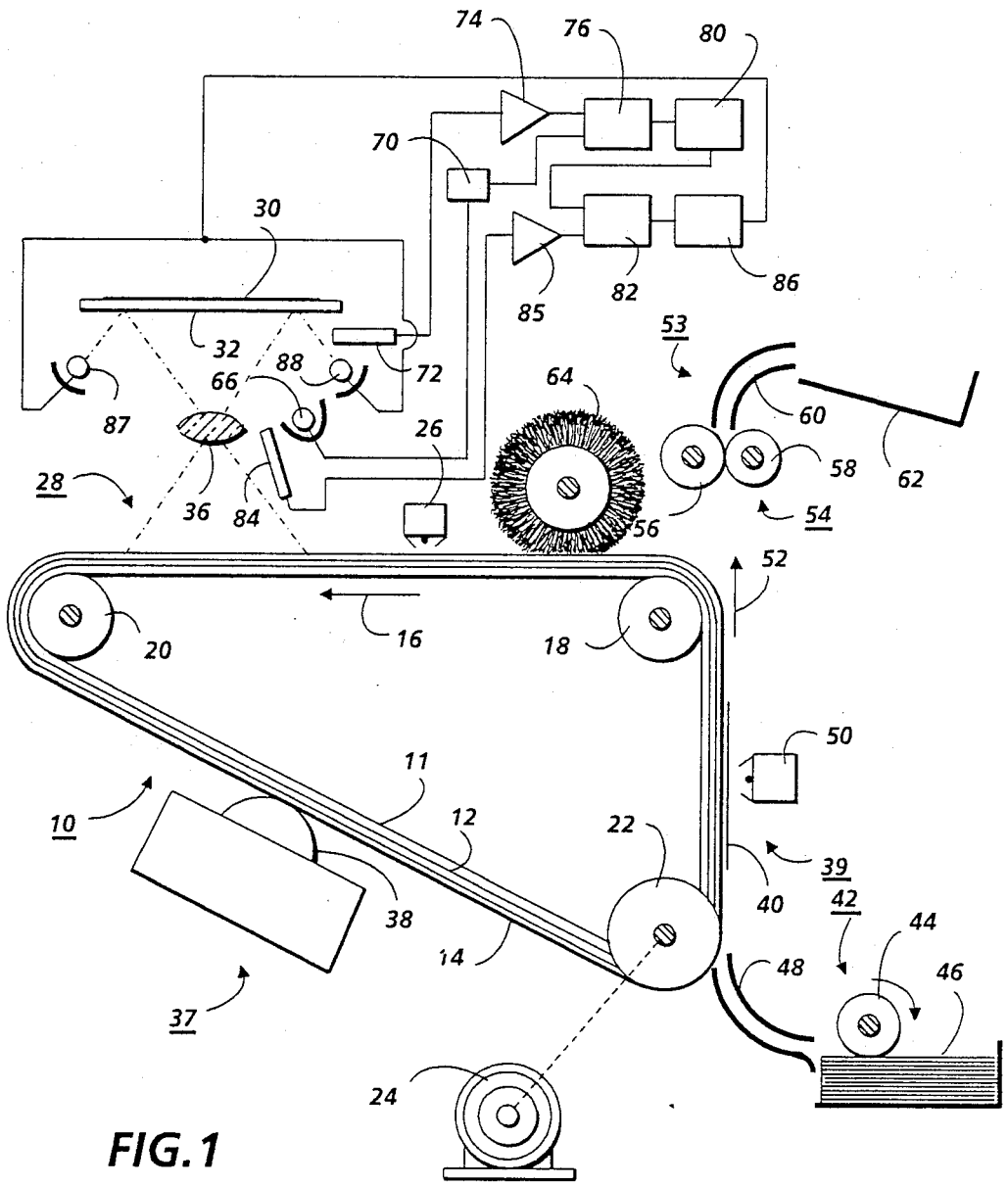
FIG. 1 shows a schematic elevational view depicting an electrostatographic imaging machine incorporating one embodiment of the present invention.

Inasmuch as the art of electrostatographic imaging is well known, the various processing stations employed in the printing system illustrated in the drawing will be described only briefly.

An electrostatographic imaging machine is illustrated in FIG. 1. The electrostatographic imaging machine utilizes a photoconductive belt 10 which comprises an electrically conductive substrate 11, a charge generating layer 12 comprising photoconductive particles dispersed in an electrically insulating binder and a charge transport layer 14 comprising a transparent electrically inactivate resin having dissolved therein one or more charge transporting molecules. A photoreceptor of this type is disclosed, for example, in U.S. Pat. No. 4,265,990 issued May 5, 1981. The entire disclosure of this patent is incorporated herein by reference. Photoconductive belt 10 is transported in the direction of arrow 16 to advance successive portions thereof sequentially through various processing stations disposed about the path of movement thereof. Photoconductive belt 10 is entrained about stripping roller 18, tension roller 20 and drive roller 22. Drive roller 22 is coupled to motor 24 by suitable means such as a drive belt. Photoconductive belt 10 is maintained in tension by a pair of springs (not shown) resiliently urging tension roll 20 against photoconductive belt 10 with the desired strength force. Both stripping roller 18 and tension roller 20 are idlers which rotate freely as photoconductive belt 10 moves in the direction of arrow 16. A portion of photoconductive belt 10 passes through an exposure station 24. It is passed through a charging station which includes a corona generating device 26 which charges the imaging surface of photoconductive belt 10 to a suitable uniform potential. The charged portion of the photoconductive belt 10 is thereafter advanced through exposure station 24. At exposure station 24, an original document 30 is positioned face down upon a transparent platen 32. The light rays reflected from the original document 30 form images which are transmitted through lens 36 and projected onto the charged portion of the photoreceptor belt 10 to cause selective dissipation of the charge thereon. This forms an electrostatic latent image on the photoconductive belt 10 which corresponds to the informational area contained within the original document 30. Photoconductive belt 10 bearing the electrostatic image is then advanced to development station 37. At development station 37, a magnetic brush developer roll 38 brings toner into contact with the electrostatic latent image. The electrostatic latent image attracts the toner particles from the magnetic brush developer roller 38 to form a toner deposit corresponding to the electrostatic latent image on the photoconductive belt 10. Photoconductive belt 10 bearing the toner image is advanced to transfer station 39. At transfer station 39, a receiving sheet 40 is moved into contact with the toner image. The receiving sheet 40 is advanced to the transfer station 39 by a sheet feeding apparatus 42. Preferably, the sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of supporting material into contact with photoconductive belt 10 in a timed sequence so that the toner image contacts the advancing sheet of support material at transfer station 39. Transfer station 39 includes a corona generating device 50 which sprays ions of a suitable polarity onto the rear surface of receiving sheet 40 so that the toner image is attracted from the photoconductive belt 10 to sheet 40. After transfer, the sheet 40 advances in the direction of arrow 52 onto a conveyer (not shown) which carries the sheet to a fusing station 53. The fusing station 53 includes a fuser roll assembly 54 which permanently affixes the transferred toner image to sheet 40. The fuser assembly 54 may include a heated fuser roll 56 adapted to engage the toner images in cooperation with a backup roll 58 to permanently affix the toner image to sheet 40. After fusing, chute 60 guides the advancing sheet 40 to catch tray 62 for removal from the printing machine by the operator. A cleaning brush 64 positioned at a cleaning station for removing residual toner from the photoconductive belt 10.

An ultraviolet lamp 66 is positioned below transparent platen 32 to illuminate original document 30 and cause phosphorescent emission from any phosphor particles in original document 30. Ultraviolet lamp 66 is energized by a suitable pulse generator 70 when the on button (not shown) of the copier is pressed to initiate copying. Sensing device 72, in response to the detection of an excitation pulse or pulses, transmits the pulse or pulses to amplifier 74 where it is amplified to the level required by a suitable pulse coincidence circuit 76. This coincidence circuit 76 establishes coincidence between the detected pulse or pulses and the timing pulse or pulses generated by pulse generator 70 for the excitation source. In response to verification of pulse coincidence by coincidence circuit 76, a pulse is transmitted to time delay generator 80 which generates a gating pulse to enable phosphorescence signal gate 82 in the phosphorescence detection circuit. Sensing device 84, in response to detection of phosphorescence emission from original document 30 transmits an electrical impulse to amplifier 85 where it is amplified to the level required by gate 82. If enabled by a gating pulse from time delay generator 80, gate 82 delivers an electrical impulse to relay 86 which disables the exposure lamps 87 and 88 of the illumination system so that original document 30 is unexposed at exposure station 24. Power to exposure lamps 87 and 88 remains disconnected until the copier cycles out. The same sequence is initiated following a new approach to the copier.

In operation, an original document 30 not treated with phosphor particles is placed on platen 32 at exposure station 24 and the on button (not shown) of the copier is pressed to initiate copying. If no phosphorescent emissions are detected by sensing device 84, the sensing device 84 does not transmit any electrical impulse to amplifier 85 and relay 86 is not activated. Thus, lamps 87 and 88 illuminate original document 30 and the copying cycle continues through the normal developing, transfer and fusing steps. However, if an original document 30 treated with phosphor particles is placed on platen 32 and the on button is pressed to initiate copying, the phosphor particles are activated by ultraviolet light from ultraviolet lamp 66 and phosphorescent illumination is detected by sensing device 84. Sensing device 84 transmits a signal through amplifier 85 so as to activate relay 86 and cut off power to lamps 87 and 88. Power to exposure lamps 87 and 88 remains disconnected until the copier cycles out. The initiating of a new copy cycle for a new original document begins the document "interrogation" process once again.

Figure 2:
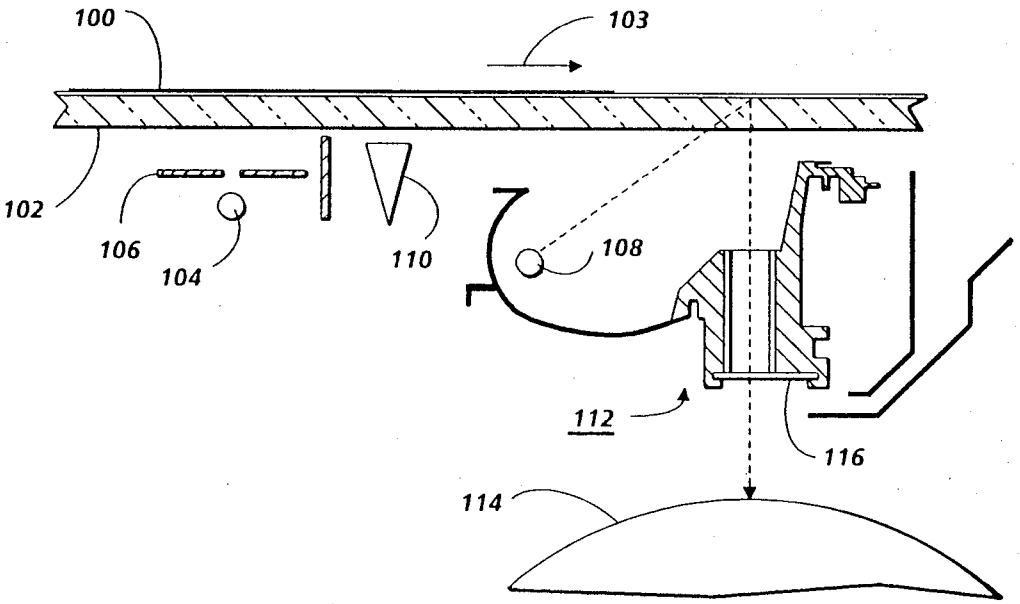
FIG. 2 shows a schematic elevational view depicting an electrostatographic imaging machine incorporating another embodiment of the present invention.

Referring to FIG. 2, web 100 supported on a transparent moving platen 102 driven by conventional means (not shown) in the direction indicated by arrow 103 is illuminated by excitation source 104 through slit 106 prior to imaging exposure by exposure lamp 108. Illumination in a slit wise fashion permits phosphorescence detection by detector 110 at a location adjacent to and upstream relative to the direction in which web 100 is translated. If no phosphorescent emissions are detected by detector 110, the detector 110 does not transmit any electrical impulse to a suitable amplifier (not shown) and a suitable relay (not shown) is not activated. Thus, exposure lamp 108 illuminates web 100 and light reflected from web 100 passes through lens assembly 112 to previously charged photoreceptor 114. If desired, a filter 116 may be employed to regulate the wavelength range of light transmitted from web 100 to photoreceptor 114. The copying cycle continues through conventional developing, transfer and fusing steps. However, if at least the lower surface of web 100 contains phosphor particles and copying is initiated, the phosphor particles are activated by ultraviolet light from ultraviolet excitation source 104 and the resulting phosphorescent illumination is detected by detector 110. Detector 110 transmits a signal through the amplifier to activate the relay and cut off power to exposure lamp 108. Power to exposure lamp 108 remains disconnected until the copier cycles out. Initiation of a new copy cycle for a new original web renews the document interrogation process.

An advantage of the web of this invention is that the web has the appearance of ordinary paper. The imaging cycle disabling system is also simple to implement in any product because it is independent of lamp and photoreceptor characteristics. Further, the hardware necessary for modifying a copier to prevent copying requires only low cost hardware. In addition, it is difficult for one to detect that the web of this invention has been modified to prevent copying, for example, by simple blacklight inspection. Further, the web of this invention may be utilized in all electrostatographic imaging systems independent of the specific photoreceptor or exposure lamp characteristics of the system. Also, the copy prevention system of this invention may be easily turned off by the owner of the machine when desired as, for example, by a key operated lock. Moreover, the user rather than the manufacturer can readily control security for sensitive documents.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. A web having phosphor particles uniformly distributed on at least one outer surface of said web, said phosphor particles being substantially white or colorless under ambient room light illumination and which upon excitation by ultraviolet light having a wavelength between about 200 nanometers and about 400 nanometers phosphoresces to emit visible blue radiation having a wavelength longer than said ultraviolet light wavelength, said visible blue radiation being between about 400 nanometers and about 500 nanometers and being detectable on a period of at least 500 microseconds following termination of ultraviolet excitation.

2. A web according to claim 1 wherein said phosphor particles emit radiation for a period of at least 1 microsecond following termination of said ultraviolet excitation.

3. A web according to claim 1 wherein said phosphor particles are activatable by ultraviolet activating radiation having a wavelength range between about 350 nanometers and about 400 nanometers.

4. A web according to claim 1 wherein said phosphor particles have an average particle size of between about 1 micrometer and about 50 micrometers.

5. A web according to claim 1 wherein said phosphor particles are uniformly distributed on said outer surface of said web in a random pattern.

6. A web according to claim 1 wherein at least about 300 milligrams per square meter of said phosphor particles is uniformly distributed on said outer surface of said web.

7. A web according to claim 1 wherein said web comprises a light absorbing image on said outer surface of said web.

8. An imaging process comprising providing a web having phosphor particles uniformly distributed on at least one outer surface of said web, said phosphor particles being substantially white or colorless under ambient room light illumination and which upon excitation by ultraviolet light phosphoresces to emit visible radiation for a detectable period after ultraviolet light excitation, said outer surface bearing a light absorbing image, illuminating said outer surface bearing said image with ultraviolet light during an electrostatographic imaging cycle to cause said phosphor particles to emit visible light, terminating said illumination of said outer surface bearing said image with said ultraviolet light, detecting said visible light emitted by said phosphor particles after terminating said illumination, and altering at least one element of said electrostatographic imaging cycle in response to the detection of said visible light whereby said electrostatographic imaging cycle is disabled.

9. An imaging process according to claim 8 including detecting said visible light emitted by said phosphor particles at least 1 microsecond following termination of said ultraviolet light excitation.

10. An imaging process according to claim 8 including detecting said visible light emitted by said phosphor particles at least 500 microseconds following termination of said ultraviolet light excitation.

11. An imaging process according to claim 8 wherein said ultraviolet light activating radiation has a wavelength between about 200 nanometers ad about 400 nanometers.

12. An imaging process according to claim 8 wherein said ultraviolet light activating radiation has a wavelength between about 350 nanometers and about 400 nanometers.

13. An imaging process according to claim 8 including providing a gating signal to delay for a predetermined time period said detecting of said visible light emitted by said phosphor particles.

14. Imaging apparatus comprising means to support a web having phosphor particles uniformly distributed on at least one outer surface of said web, said phosphor particles being capable of phosphorescence to emit visible radiation upon excitation by ultraviolet light, means to apply ultraviolet light to said phosphor particles, means to terminate application of said ultraviolet light to said phosphor particles, means adapted to detect said visible radiation emitted by said phosphor particles after said application of said ultraviolet light to said phosphor particles is terminated, and means to disable operation of said imaging apparatus upon detection of said visible radiation emitted by said phosphor particles after said application of said ultraviolet light to said phosphor particles is terminated.

15. Imaging apparatus according to claim 14 including means to provide a gating signal to delay, for a predetermined time period following initiation of said excitation by said ultraviolet light, detection of said visible light emitted by said phosphor particles by said means to detect said visible radiation.

16. Imaging apparatus according to claim 15 wherein said means to provide a gating signal includes means to detect said ultraviolet light, said means to detect said ultraviolet light being positioned relative to said web to detect reflections of said ultraviolet light outside the specular regime scattered from said web.

* * * * *